US007456375B2

(12) United States Patent
Nishida

(10) Patent No.: US 7,456,375 B2
(45) Date of Patent: Nov. 25, 2008

(54) IMAGE HEATING APPARATUS OF INDUCTION HEATING TYPE AND EXCITATION COIL UNIT ADAPTED FOR THE USE THEREIN

(75) Inventor: Hideyuki Nishida, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/761,302

(22) Filed: Jan. 22, 2004

(65) Prior Publication Data

US 2004/0188420 A1 Sep. 30, 2004

(30) Foreign Application Priority Data

Jan. 24, 2003 (JP) ..... 2003-016333

(51) Int. Cl.
*H05B 6/04* (2006.01)
*H05B 3/02* (2006.01)

(52) U.S. Cl. ..... 219/619; 219/216

(58) Field of Classification Search ..... 219/619, 219/216, 469, 618, 600; 100/300; *H05B 6/04, H05B 3/02, 1/00*
See application file for complete search history.

(56) References Cited

U.S. PATENT DOCUMENTS 6,340,810 B2 * 1/2002 Yokoyama et al. ..... 219/619
6,605,802 B2 * 8/2003 Nagahira ..... 219/619

FOREIGN PATENT DOCUMENTS

JP 54-39645 3/1979
JP 9-197854 7/1997

* cited by examiner

*Primary Examiner*—Daniel Robinson
(74) *Attorney, Agent, or Firm*—Fitzpatrick, Cella, Harper & Scinto

(57) ABSTRACT

An excitation coil unit for use in an image heating apparatus includes a coil formed with a conductor without an insulation covering and a heat-resistant insulating material covering the coil. It is thus possible to obtain an image heating apparatus of induction heating type of a low cost.

4 Claims, 9 Drawing Sheets

| | LITZ WIRE | EMBODIMENT 1 | EMBODIMENT 2 |
|---|---|---|---|
| WIRE CONDITION | φ0.18×120 | φ0.18 | d:2.0×t:1.0 |
| THE NUMBER OF TURN-BACK | 10 | 10 | 10 |
| EFFECTIVE AREA OF WIRE [$m^2$] | 3.05E−06 | 2.54E−06 | 2.00E−06 |
| RESISTANCE VALVE [Ω] | 0.070 | 0.084 | 0.107 |
| POWER LOSS [W] | 5.05 | 6.06 | 7.71 |
| MAXIMUM CURRENT DENSITY Is [A/$m^2$] | 4.92E+06 | 5.91E+06 | 7.50E+06 |

IMAGE HEATING APPARATUS OF INDUCTION HEATING TYPE AND EXCITATION COIL UNIT ADAPTED FOR THE USE THEREIN

BACKGROUND OF THE INVENTION

1. Field of the Invention

The present invention relates to an image heating apparatus of induction heating type adapted for use in an image forming apparatus such as a copying apparatus or a printer utilizing an electrophotographic recording technology or an electrostatic recording technology, and an excitation coil unit adapted for use in such apparatus.

2. Description of Related Art

In an image forming apparatus such as a copying apparatus, a printer or a facsimile apparatus utilizing for example an electrophotographic process, there is provided a heat fixing apparatus for thermally fusing a toner image, transferred onto a recording material such as a plain paper or an OHP sheet, thereby fixing such image onto the recording material.

The image forming apparatus utilizing such electrophotographic process is often continuously powered even when a printing operation is not executed. In the mode of use of ordinary users, a time during which the powered image forming apparatus is not used (namely stand-by time) is far longer than a time of use (printing time). During such stand-by time, a largest electric power is consumed by the fixing apparatus. Therefore, by reducing the electric power consumption of the fixing apparatus during the stand-by time, it is possible to suppress the total electric power consumption of the image forming apparatus, both in the print time and in the stand-by time. On the other hand, when the user executes a printing operation, it is desirable that the image forming apparatus can be started up from the stand-by state to the printable state within a time as short as possible. However, in case the power consumption of the fixing apparatus is suppressed during the stand-by time, the start-up time to the printable state becomes longer as the temperature of the fixing apparatus is already lowered.

As a countermeasure, it is being tried to employ an induction heating method in which a heating roller, constituted of a cylindrical conductive member, generates heat by itself, instead of a conventionally common method of heating the heating roller by a halogen lamp heater, thereby further reducing the start-up time of the heating roller to the fixing temperature and thus achieving an energy saving.

In such induction heating method, a high frequency current is given to an excitation coil and a generated magnetic flux is caused to act on a cylindrical conductive member, thereby generating an eddy current in the conductive member and heating the heating roller by a Joule's heat generated by such eddy current.

An example of such prior fixing apparatus is illustrated in FIGS. 8 and 9.

In a fixing apparatus of induction heating type shown in FIG. 8, a heating roller 50 is provided rotatably and is formed by a cylindrical conductive member. A pressure roller 51 is pressed under a predetermined pressure to the heating roller 50, and is rotated in a direction a together with the heating roller 50 to pinch and convey a recording medium 54, moving in a direction b in a nip portion formed between the heating roller 50 and the pressure roller 51, thereby applying a heat and a pressure to the recording medium and achieving an image fixation. A coil assembly 52 for generating a magnetic field, for generating an induction current in the heating roller 50, is supported by a holder 64, and constitutes a holder unit 53 as a whole.

The coil assembly 52 includes a core 63 of a magnetic material, a bobbin 65 having a through hole for inserting the core 63, and an excitation coil 62 formed by winding a copper wire around the bobbin. The bobbin 65 functions as an insulating part for insulating the core 63 and the excitation coil 62. FIG. 9 shows only the holder unit 53 provided in the heating roller.

However, the fixing apparatus utilizing such induction heating method has been associated with following drawbacks.

The excitation coil is not heated by radiation and conduction of heat from the heating roller which generates heat, but also generates heat by Joule's heat, because a current flows in the excitation coil itself. Therefore, in case a fixing apparatus of induction heating type is mounted on a high-speed apparatus with a higher print output per unit time, the coil temperature is gradually elevated in a prolonged operation and may eventually exceed a heat resistant temperature of the coil.

In particular, a resinous insulation layer provided on the wire of the coil may be fused to cause a shortcircuiting.

In order to avoid such situation, it is proposed to blow air in the interior of the excitation coil along an axial direction thereof, thereby suppressing an increase in the coil temperature.

On the other hand, there is also proposed to reduce the heat generation of the coil itself thereby causing a curve of the coil temperature to saturate at a lower temperature. More specifically, there is adopted a method of reducing a resistance of the coil wire by employing a larger diameter in the wire constituting the coil or by employing a litz (twisted) wire, formed by bundling plural fine wires, for forming the coil, or a method of forming the cylindrical conductive member with a material of a high electrothermal converting efficiency thereby obtaining a higher output with a smaller current.

However, in the method of suppressing the temperature increase of the coil by air blowing, among the electric power supplied to the coil of the fixing apparatus, a heat corresponding to the Joule's loss of the coil is lost by such air blowing.

In an investigation of the present inventors, such lost energy may amount to several tens of watts, and a fact that such heat cannot be effectively utilized for fixation is against energy saving. Also unless an appropriate air blowing method is adopted, even the heat of the heating roller may also be dissipated and lost, thereby leading to a further waste of the energy.

Also among the methods of reducing the heat generation of the coil itself thereby causing a curve of the coil temperature to saturate at a lower temperature, the method of increasing the diameter of the wire thereby reducing the electrical resistance of the coil has a drawback that the electrical resistance is not much lowered, since, in the fixing apparatus of induction heating type, the excitation coil is usually given a high frequency current so that the current flows only in a surface portion of the conductor by so-called "skin effect".

As a countermeasure therefor, it is conceived to form the coil with a twisted wire (litz wire) formed by twisting plural insulated wires (element wires), but such method results in a higher cost. Also in a configuration employing a twisted wire, since the element wire constituting the twisted wire is insulated, the fixing apparatus has to be so designed that the heat-resistant temperature is not exceeded. As polyimide is usually employed for the insulation of the element wire, it is necessary to design the coil in this case in such a manner that the coil temperature does not exceed 220° C. Stated differently, in case of employing a twisted wire, the upper limit of the temperature of the coil assembly is restricted by the heat resistance of the insulating material of the element wire constituting the twisted wire. Therefore, the fixing apparatus of inducting heating type employing such twisted wire is difficult to apply to the printer with a high output per unit time, in which the electric power supplied to the coil has to be increased.

Also in the method of forming the cylindrical conductive member (heating roller) with a material of a high electrothermal converting efficiency, such cylindrical conductive member is required, in constituting the fixing apparatus, not only to have a high heat generating efficiency but also to meet other conditions such as durability and working property, and it is difficult to meet all these requirements.

Also a composite material formed by laminating aluminum, nickel, copper etc. and called a clad material is utilized for example in a rice cooker etc. utilizing the induction heating method, but such material inevitably becomes expensive.

SUMMARY OF THE INVENTION

The present invention has been made in consideration of the foregoing, and has an object of providing an image heating apparatus of induction heating type of a low cost, and an excitation coil unit adapted for use in such apparatus.

Another object of the present invention is to provide an image heating apparatus of induction heating type, applicable to a printer with a high output per unit time, and an excitation coil unit adapted for use in such apparatus.

Still another object of the present invention is to provide an excitation coil unit with a suppressed heat capacity.

Still another object of the present invention is to provide an excitation coil unit including a coil formed with a conductor without an insulating coating, and a heat-resistant insulating material covering such coil.

Still another object of the present invention is to provide an excitation coil unit including a coil formed with a conductor without an insulating coating, and an insulating spacer mounted on such coil in such a manner that the conductors of the coil do not mutually contact.

Still another object of the present invention is to provide an image heating apparatus including a conductive rotatable member, and an excitation coil unit for generating a magnetic field to induce an eddy current in the conductive rotatable member, wherein the excitation coil unit includes a coil formed with a conductor without an insulating coating, and a heat-resistant insulating material covering the coil.

Still further objects of the present invention will become fully apparent from the following detailed description which is to be taken in conjunction with accompanying drawings.

DESCRIPTION OF THE PREFERRED EMBODIMENTS

In the following, preferred embodiments of the present invention will be explained, as representative examples, in detail with reference to accompanying drawings. However, it is to be understood that dimension, material, shape, relative arrangement etc. of components described in these embodiments are not to restrict the present invention to such description unless otherwise specified.

First Embodiment

Figure 1:
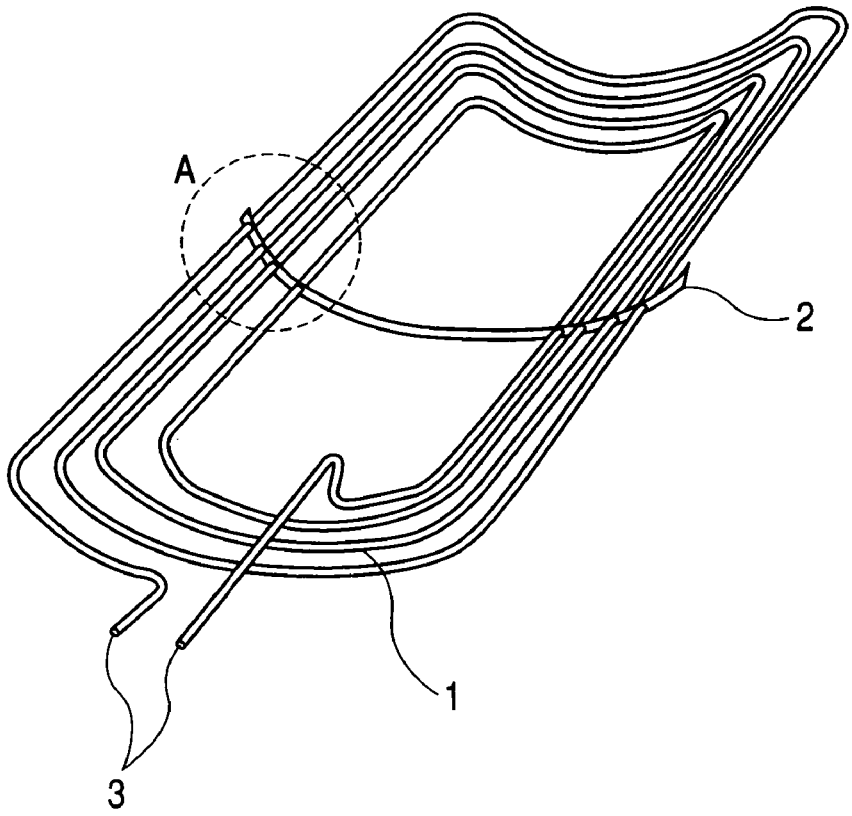
FIG. 1 shows a perspective view showing an excitation coil in a first embodiment of the present invention.

FIG. 1 is a perspective view showing an excitation coil in a first embodiment of the present invention.

Referring to FIG. 1, an excitation coil 1 is formed by a conductor having a circular cross section and having no insulating covering on the surface. The excitation coil 1 is also provided with a spacer 2 for maintaining a predetermined distance between conductors thereby preventing a shortcircuiting.

Figure 2:
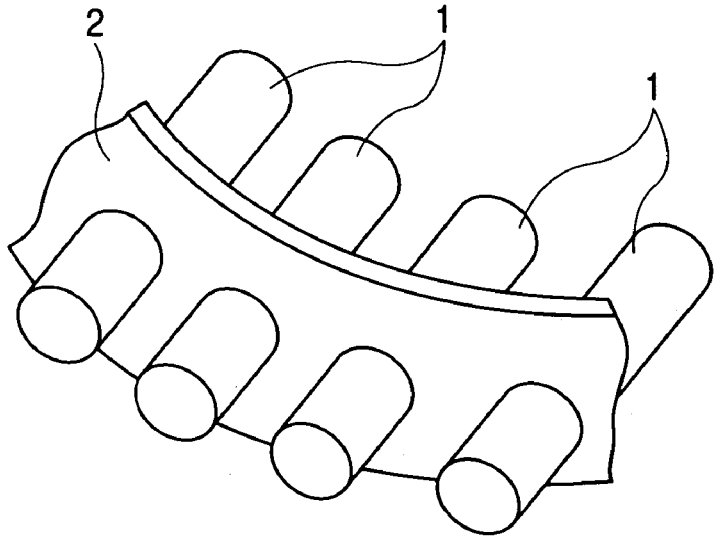
FIG. 2 shows a partially cut-off magnified perspective view of a portion A of the excitation coil in the first embodiment of the present invention.
Figure 12:
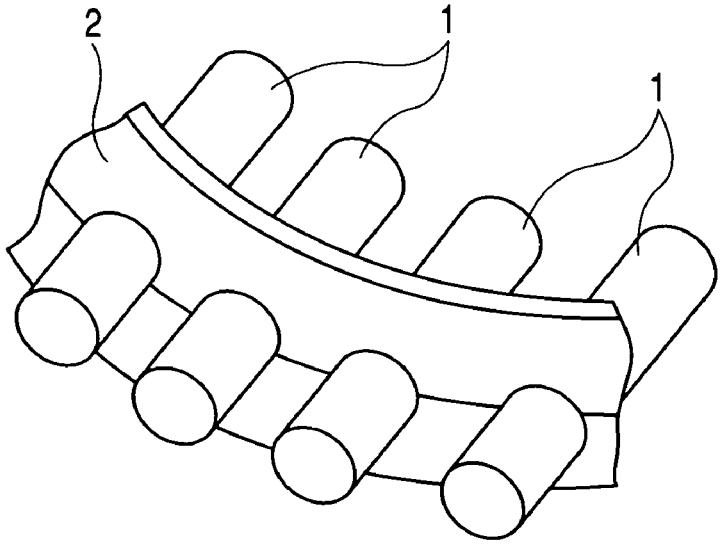
FIG. 12 shows a magnified view of a portion A of the excitation coil, showing details of FIG. 2.

FIG. 2 is a magnified view of a portion A indicated by a broken line in FIG. 1. As shown in FIG. 2, conductors 1 are prevented from mutual contact by a spacer 2. Though FIG. 2 does not show a division line, the spacer 2 is rendered dividable into upper and lower portions as shown in FIG. 12. The spacer 2 is provided in advance with recesses for fitting the conductors.

Figure 11:
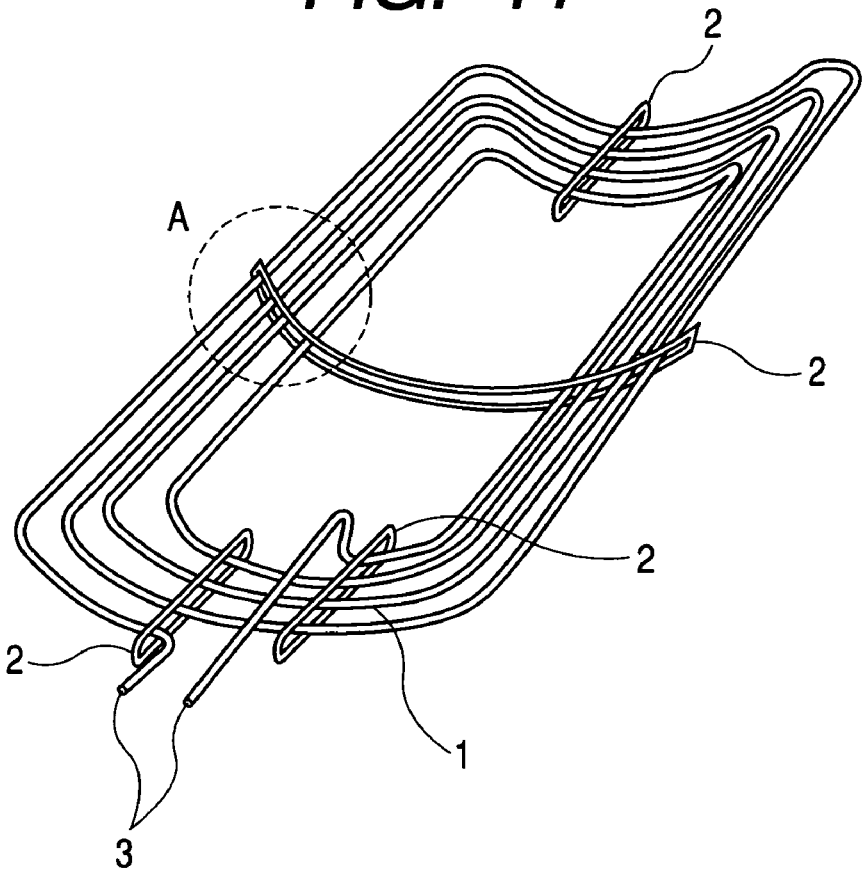
FIG. 11 shows a perspective view of an excitation coil in an example provided with a spacer, shown in FIG. 1, in plural units.

The spacer 2 is constituted of an insulating material such as a heat-resistant resin, and has a function, in case of integrally covering the excitation coil together with the spacer mounted thereon by injection molding or potting with a non-magnetic heat-resistant insulating material, of preventing a shortcircuiting resulting from a displacement of coil conductors by a flow of a resinous material used as the heat-resistant insulating material. Though FIG. 1 shows only one spacer 2, but it may be provided in plural positions if necessary as shown in FIG. 11.

Figure 3:
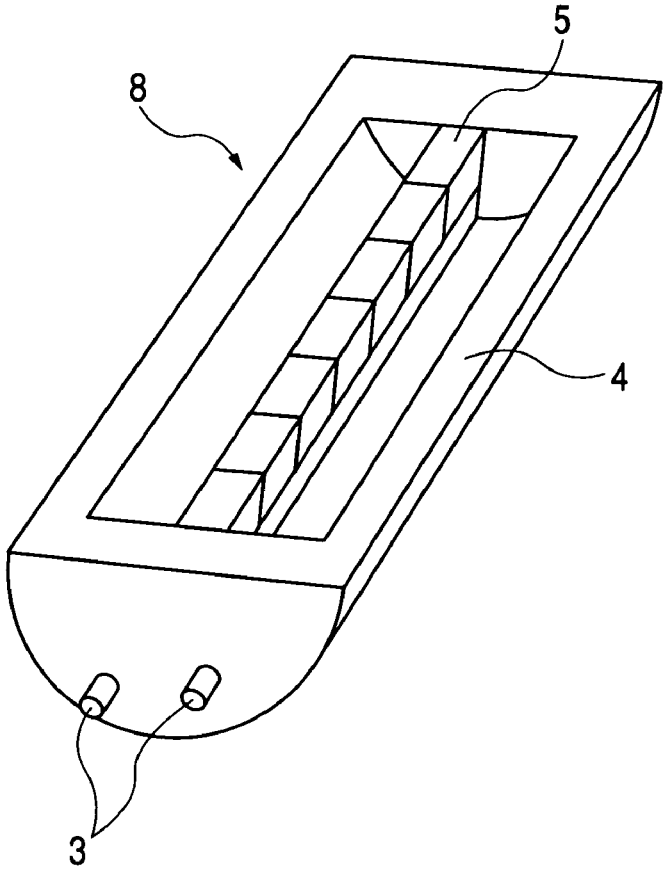
FIG. 3 shows a perspective view of an excitation unit in the first embodiment of the present invention.
Figure 4:
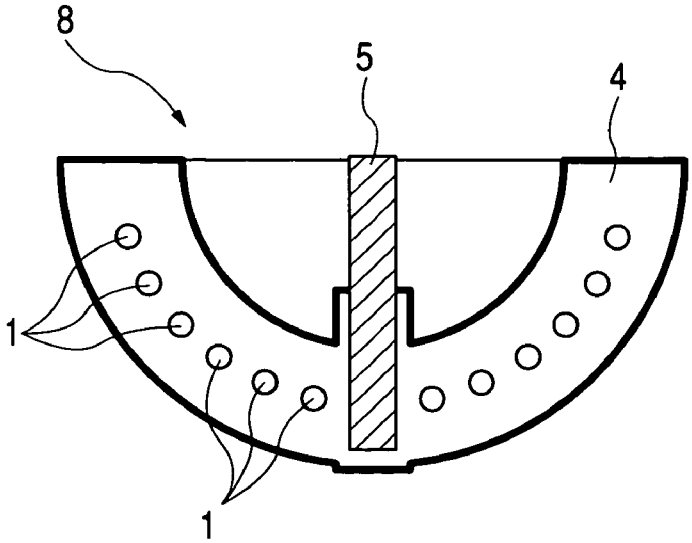
FIG. 4 shows a cross sectional view in a central portion of the excitation coil in the first embodiment of the present invention.

FIG. 3 is a perspective view of an excitation unit (excitation coil unit) 8 in the present embodiment, and FIG. 4 is a cross sectional view of a central portion of the excitation unit 8 shown in FIG. 3. In FIG. 3, a holder 4 is formed by integrally covering the excitation coil 1, in a state mounted with the spacer as shown in FIG. 1 or 11, with a non-magnetic heat-resistant insulating material by injection molding or potting. The holder 4 is provided with terminals 3 for electric power supply to the excitation coil, for supplying the excitation coil 1 with a high frequency current.

The holder 4 is formed by an organic resinous material with a heat resistance of 200° C. or higher, or a hybrid material formed by adding, to such organic resinous material, a filter of a higher thermal conductivity than in the resinous material, such as silica or ceramic powder.

In this manner, an integration with the excitation coil 1 can be achieved easily and inexpensively, without deformation or fusing of the heat-resistant insulating material by a temperature increase in the excitation coil 1. Consequently, even in case the excitation coil 1 reaches a high temperature, there can be avoided drawbacks such as a shortcircuiting between the conductors or a deformation of the coil shape, and the heat generated in the excitation coil 1 itself can be transmitted to the exterior. Besides, a suitable selection of the filler can increase the thermal conductivity of the heat-resistant insulating material whereby the heat generated in the excitation coil 1 itself can be efficiently transmitted to the exterior.

A core 5 for regulating the inductance of the excitation unit 8 is formed by a magnetic material such as ferrite. The core 5 constitutes a part of a magnetic circuit for causing an alternating magnetic flux, generated in the excitation coil 1, to effectively act on a cylindrical metal member.

Figure 14:
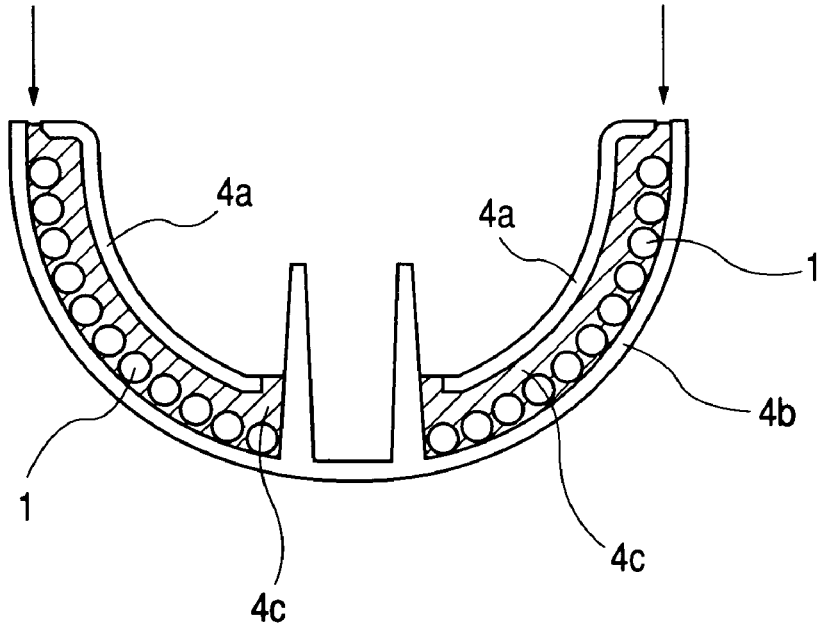
FIG. 14 shows a detailed cross sectional view of a central portion of an excitation coil unit in the first embodiment of the present invention.

Now reference is made to FIG. 14 for a more detailed description of the excitation coil unit 8 of the present embodiment.

Figure 13:
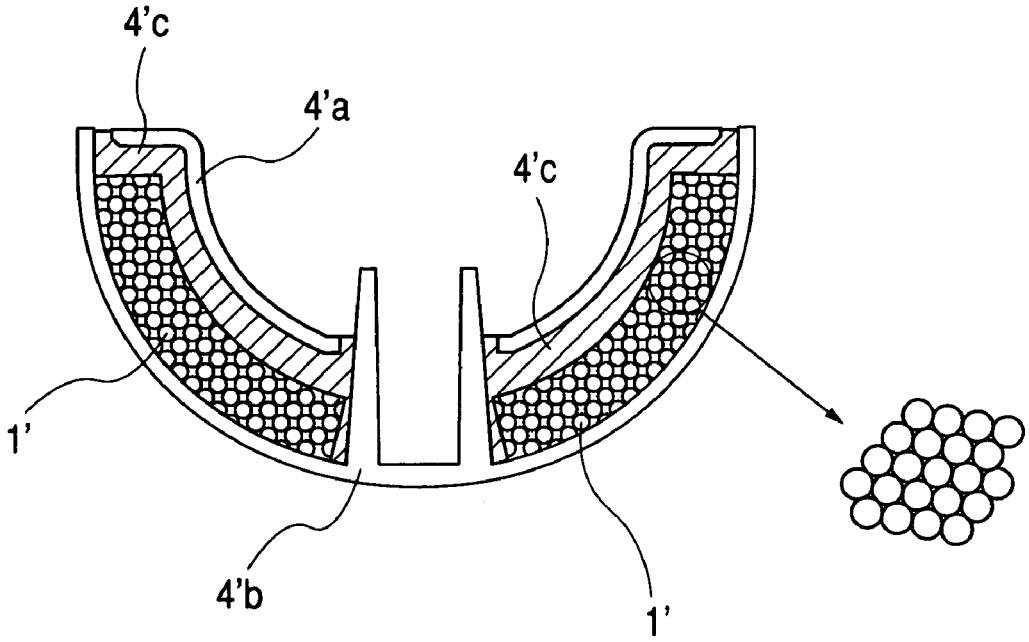
FIG. 13 shows a cross sectional view of an excitation coil unit of a comparative example, employing a twisted wire as a coil conductor.

FIG. 13 is a cross sectional view of a comparative excitation coil unit, to be referenced in understanding the present invention. Referring to FIG. 13, an excitation coil 1' is formed by 10 turns of a litz (twisted) wire, formed by twisting plural element wires (PIW: polyimide covered wire), followed by press molding. As shown in a partial magnified view, by press molding a coil formed with twisted wires, the element wires assume a state where they are relatively regularly arranged in a grid pattern (in such state, it is difficult to identify a number of turn to which each wire belongs).

4'*a*, 4'*b* and 4'*c* indicate constituents of the holder 4, in which 4'*a* is an upper mold member formed in advance by injection molding, while 4'*b* is a lower mold member similarly formed in advance.

4'*c* indicates an insulating resinous material, indicated into a space inside the holder 4 (formed by a combination of the upper and lower mold members 4'*a*, 4'*b*) containing the excitation coil 1' after the press molding. 4'*a*, 4'*b* and 4'*c* are constituted of a same insulating resinous material of a high heat resistance.

Such insulating resinous material can be, for example, a liquid crystal polymer (LCP) of a totally aromatic polyester resin such as Zenite (R) 6000 (registered trade name of Dupont deNemeurs), or a polyetherether ketone polymer such as Victrex (R) PEEK (R) 450GL300, belonging to so-called super engineering plastics. These materials have a heat-resistant temperature of about 260° C.

For use in an image heating apparatus, the filler is preferably added in an amount of 30 to 50%, particularly for improving the heat resistance. An excessively large amount of addition may result in a brittleness, thereby becoming unable to maintain a required mechanical strength. Also a mold for injection molding is scraped, thus resulting in a deterioration in the "mold life".

However, in such configuration employing twisted wires, since each element wire constituting the twisted wire is insulation covered, the fixing apparatus has to be so designed that the insulation covering of the element wire does not exceed the heat-resistant temperature. Polyimide is usually employed as the insulating covering of the element wire, and, in such case, the fixing apparatus has to be so designed that the coil temperature does reach 220° C. or higher.

Thus, even though the twisted wires are covered with the molding materials 4'*a*, 4'*b*, 4'*c* of a high heat resistance, the use of the element wire having the insulating covering leads to a restriction that the coil has to be designed in such a manner that the temperature increase thereof is saturated at 220° C. or less. Therefore, such fixing apparatus of induction heating type, utilizing the twisted wires, is difficult to apply to a printer with a high output per unit time, in which an electric power supply to the coil has to be made inevitably high.

Therefore, the present embodiment employs a conductor without an insulation covering as the wire constituting the coil. FIG. 14 is a cross sectional view showing details of the excitation coil unit of the present embodiment. FIG. 14 shows a state in which a core 5 is omitted in the cross section shown in FIG. 4.

In FIG. 14, 1 indicates an excitation coil of the present embodiment as shown in FIGS. 1 and 11. This example employs a copper wire of a diameter of 1.8 mm without an insulating covering. The copper wire is subjected to a nickel plating as a barrier metal for antirusting. In FIG. 14, the spacer shown in FIGS. 1 and 11 is omitted.

4*a*, 4*b* and 4*c* indicate constituents of the holder 4, in which 4*a* is an upper mold member formed in advance by injection molding with a heat-resistance resin same as in FIG. 13, while 4*b* is a lower mold member similarly formed in advance with a material same as in 4*a*.

The lower mold 4*b* is required to have a thickness of 0.4 mm or larger as an insulating material defined by UL (Underwriters Laboratories Inc.) standard, and a thickness of 0.5 mm is adopted for meeting the insulation standard, since a smaller heat resistance to the heating roller is preferable.

Figures 15, 16:
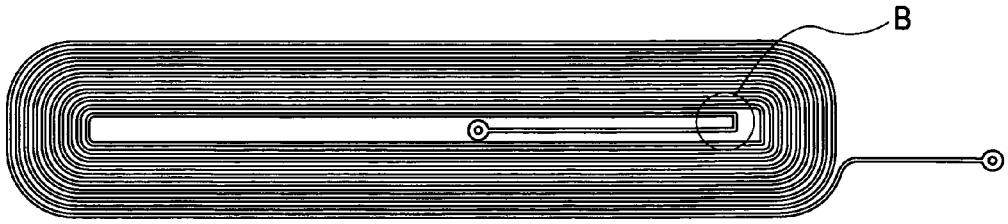
FIG. 15 shows a plan view of an excitation coil in the second embodiment of the present invention, after punching out from a metal plate by a pressing step.
FIG. 16 shows the comparison of specific data among a case of employing a twisted wire as the coil conductor and cases of coils of the first and second embodiments.

Now, a specific configuration of the excitation coil 1 employed in the present embodiment will be explained with reference to FIG. 16. FIG. 16 shows a table showing a comparison of specifications among a representative example employing twisted (litz) wires in the excitation coil, and excitations coils of the embodiment 1 and an embodiment 2 to be explained in the following.

In this table, a resistance was calculated from a resistivity of copper, converted to 200° C. Also a DC power loss corresponds to a current of 8.5 A charged into the excitation coil, in consideration of an electric power of 850 W consumed by the fixing device in an ordinary operation.

Also a maximum current density Is was defined as follows:

*Is*=maximum rated current [*A*] obtainable from a single AC receptacle of a commercial power supply÷effective area (cross section) [$m^2$] of a wire of excitation coil.

A maximum rated current [A] obtainable from a single AC receptacle of 100 V power supply in Japan is 15 A (for reference, $10^6$ [A/m$^2$] corresponds to 1 [A/mm$^2$].

As will be understood from this table and the foregoing description, the embodiment 1 and the embodiment 2 to be explained later can employ a conductor of a higher resistance than in the twisted wire, namely a conductor of a lower cost, since the heat generation in the conductor may be made larger than in the case of the twisted wire. Also the maximum current density in the conductor may be made larger, so that the heat generation of the heating roller may be larger than in the prior technology, thereby facilitating application to a printer of a higher output per unit time.

In the following there will be explained a producing method for the excitation coil unit 8 of the present embodiment.

At first a bobbin (not shown) and a winding machine (not shown) are used to wind a conductor of ϕ1.8 by 10 turns into a coil shape as shown in FIGS. 1 and 11, and then a spacer 2 for preventing shortcircuiting is mounted on the coil.

Then the preformed coil 1 is fitted into the lower mold member 4*b* and is covered with the upper mold member 4*a*.

Then an uncompleted holder 4 (combination of the upper mold member 4*a* and the lower mold member 4*b*) containing the coil 1 is set in a mold for injection molding. Between the upper mold member 4*a* and the lower mold member 4*b*, there is formed in advance a gate (in a position indicated by an arrow in FIG. 14) for injecting a resin.

Then a heat-resistant resin (heat-resistant insulating material) 4*c* is injected from the gate of the holder 4, set in the mold for injection molding, thereby filling the gap between the upper mold member 4*a* and the lower mold member 4*b* and thus integrating the upper mold member 4*a*, the lower mold member 4*b* and the coil 1. The spacer 2 mounted on the coil 1 allows to prevent mutual contact of the conductors at the injection of the heat-resistant resin 4*c*.

Finally the holder 4 is taken out from the mold, and is completed by a finishing work such as a deburring. If necessary, a core is mounted in a central recess shown in FIG. 14, in a manner as shown in FIGS. 3 and 4.

Such use of a conductor without insulation covering, as the wire constituting the coil, allows to construct an inexpensive excitation coil unit. Also such coil, being usable even in case the coil temperature rises to the heat-resistant temperature of of the heat-resistant resin 4*a*, 4*b*, 4*c* (about 260° C. in the present embodiment) covering the coil, can be applied to a printer with a large output per unit time, thereby providing an advantage of widening the freedom in designing.

Also the presence of the spacer 2 allows to prevent a mutual contact of the conductors in sealing the coil with the heat-resistant resin, thereby providing an advantage of simplifying the manufacture of the excitation coil unit.

Figure 5A:
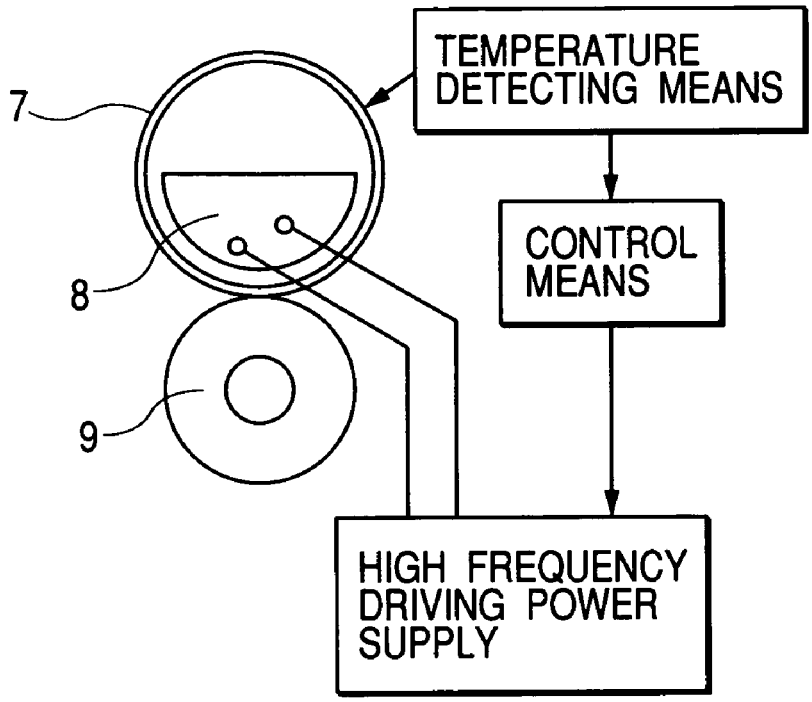
FIGS. 5A, 5B and 5C show schematic views showing variations of a fixing apparatus and an excitation unit in the first embodiment of the present invention.
Figure 5B:
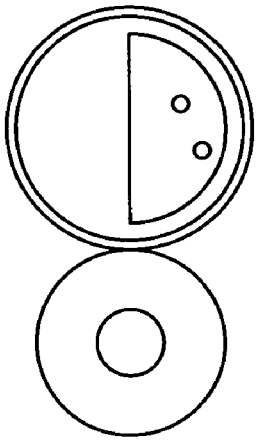
Figure 5C:
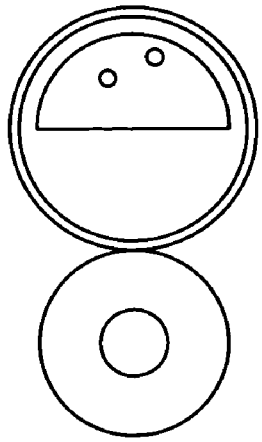

FIGS. 5A to 5C are schematic views showing variations of the arrangement of the excitation unit 8 in the fixing apparatus, employing the excitation coil unit of the present embodiment.

Referring to FIGS. 5A to 5C, an excitation coil unit 8 is positioned inside a cylindrical conductive member constituting a heating roller (heating member) 7, and is formed by integrally molding an excitation coil 1 and a core 5 with a holder of a non-magnetic heat-resistant insulating material. A pressure roller 9 is pressed under a predetermined pressure to the heating roller 7.

In the present embodiment, as explained in the foregoing, the excitation coil 1 is integrally covered by the holder 4 to form the excitation coil unit 8, so that it is possible not only to prevent the mutual shortcircuiting of the wires of the excitation coil 1 but also to prevent a shortcircuit by a contact between the excitation coil 1 and the heating roller 7 even when the excitation coil 1 positioned close to the heating roller 7 constituted by the cylindrical conductive member and also to prevent a deformation of the excitation coil 1 by an external force or by a weight thereof, whereby the excitation coil 1 can be easily handled or positioned.

Also the holder 8, being formed with a non-magnetic heat-resistant insulating material, does not affect a magnetic field generated by a current supply to the excitation coil 1 nor cause a mutual shortcircuiting of the conductors in a temperature increased state of the excitation coil 1 or a deformation or a fusing of the holder 4 integrally covering the entire coil surface.

Also as explained in the foregoing, the excitation unit 8 exerts a following function.

A high frequency current (about 10 to 1200 kHz) is supplied from an external high frequency source to the excitation coil 1, and a magnetic flux generated therein is caused to act on the cylindrical metal member, constituting the heating roller 7, thereby inducing an eddy current therein by an electromagnetic induction, and a Joule's heat generated by such eddy current is utilized in a fixing apparatus of a copying apparatus or a printer, employing toner.

In this operation, heat generated in the excitation coil 1 itself is transmitted, through the holder 4 constituted of the non-magnetic heat-resistant insulating material and a heat radiation through the air around the holder 4, to the cylindrical metal member constituting the heating roller 7.

Thus the heating roller 7 can be efficiently heated by the heats of the aforementioned two types.

In the fixing apparatus of the present embodiment, the temperature of the heating roller 7 is detected by temperature detection means as shown in FIGS. 5A to 5C, and control means controls a high frequency power source in such a manner that the detected temperature reaches a fixing temperature sufficient for fusing the toner and fixing it onto the recording medium (about 160 to 200° C.).

In the present embodiment, the excitation coil 1 is constructed with such a resistance that the excitation coil can function, by a current supply, at or under a temperature causing a deterioration in the paper or OHP sheet.

In this manner it is rendered possible to avoid a danger that the recording medium is deteriorated by a temperature increase in the excitation coil, not only in a normal operation state but also in case an unexpected current is supplied to the excitation coil for example by a failure in the control means. Also in the present embodiment, since a single circular-sectioned conductor is employed in the excitation coil 1, the fixing apparatus can be realized with a low cost.

Also in the preparation of the excitation unit 8, sufficient reliability thereof is secured by covering the excitation coil 1 with the heat-resistant material.

Furthermore, the excitation unit 8 is arranged along a peripheral surface of the heating roller constituted of the cylindrical conductive member, as shown in FIGS. 5A, 5B and 5C, and a distance between the cylindrical conductive member and the excitation coil is selected within a range from 0.4 to 10 mm across the insulating member, in order to facilitate heat transition to the heating roller.

As explained above, the excitation unit can be provided in such a position where the heating roller can reach an appropriate fixing temperature by a sum of the heat generated by the excitation unit itself and the heat generated by the induced current in the heating roller.

As explained in the foregoing, in contrast to the prior technical concept of suppressing a heat generation in the excitation coil by employing an excitation coil of a low power loss, the present invention adopts a structure not causing a problem even in case the coil generates a heat close to the heat-resistant temperature of the heat-resistant molding member, which covers the coil formed by the conductors without the insulation covering, thereby enabling to use an inexpensive conductor in place for an expensive twisted wire. Also it is rendered possible to increase the electric power charged into the coil, whereby an application to a printer of a high output per unit time is made possible.

For example, as a material for the heat-resistant molding member, the aforementioned heat-resistant PEEK (R) resin can be used up to a temperature of 240° C. according to UL746B. Also a heat resistance of 260 to 290° C. can be provided in a Zenite (R) 7000 series.

Also as will be understood from a comparison of FIG. 13 and FIG. 14, a coil volume can be made smaller in the present embodiment shown in FIG. 14 than in the configuration shown in FIG. 13. Therefore, the excitation coil unit has a smaller thickness, and thus a smaller heat capacity, in FIG. 14 than in FIG. 13.

Immediately after the power supply to the printer is turned on, even when the heating roller reaches a fixable temperature, other components of the fixing device are often not yet heated up. In the fixing device of induction heating type, the excitation coil unit is one of such not yet heated components. In case a printing operation is conducted continuously on plural recording sheets while the entire fixing device is not yet heated up sufficiently as explained above, the heat of the heating roller is taken away not only by the recording sheets but also by the excitation coil unit, whereby the heat generation in the heating roller is insufficient for the printing speed to result in a gradual temperature decrease in the heating roller.

Figure 10:
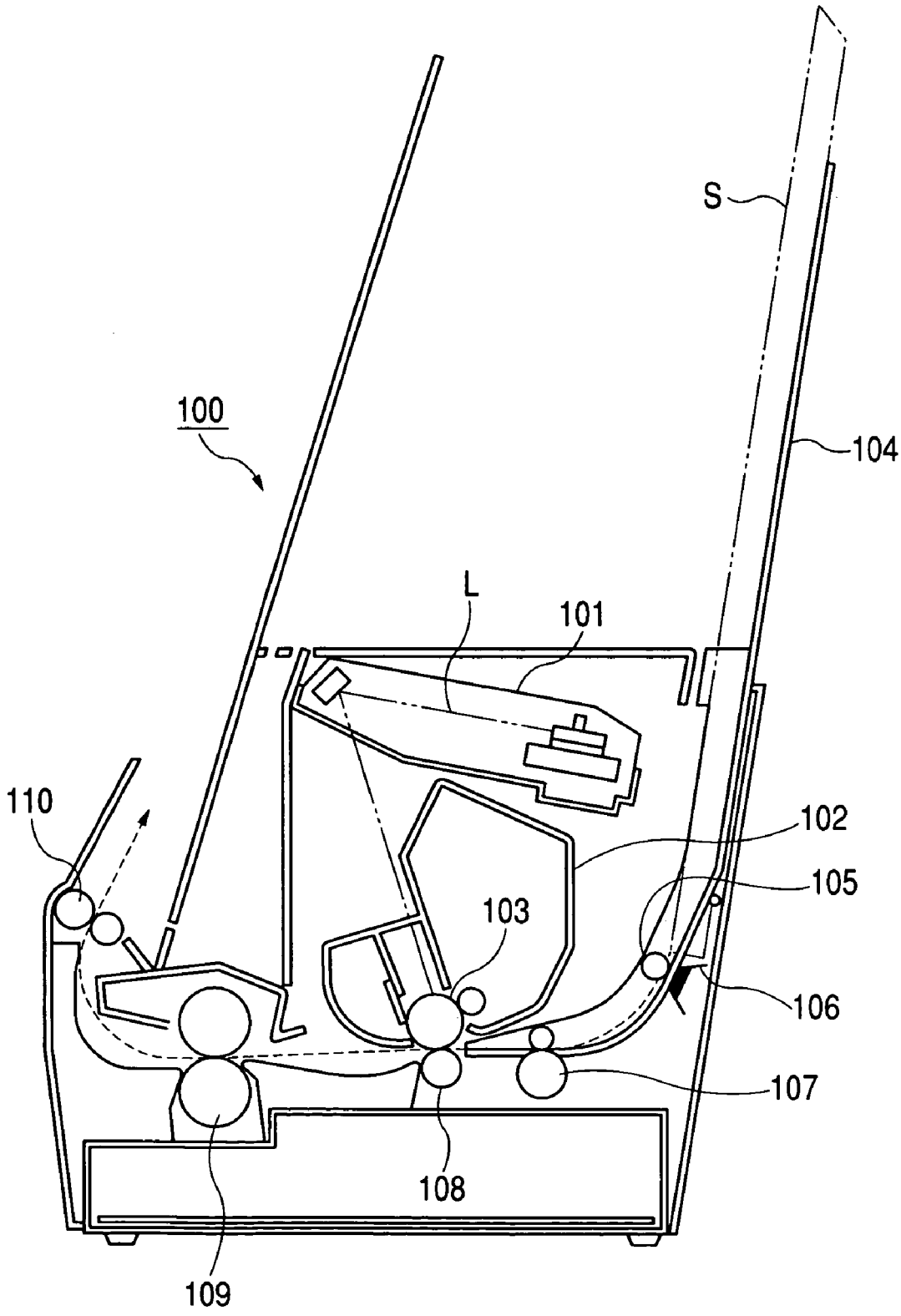
FIG. 10 shows a cross sectional view showing function of an entire image forming apparatus employing the fixing apparatus of the present invention.

However, a configuration of constituting the coil with the conductor without the insulation covering and covering such coil with the heat-resistant mold, as shown in FIG. 10, allows to reduce the heat capacity of the excitation coil unit 8, whereby it is rendered possible to reduce the heat amount taken away by the excitation coil unit after the start of the continuous printing operation and to suppress the temperature decrease of the heating roller even when the continuous printing operation is executed in a state where the entire fixing device is not yet heated up sufficiently.

Since the coil of the present embodiment is still usable even when the temperature thereof is elevated close to the heat-resistant temperature of the heat-resistant resin covering the coil, the present embodiment not only provides advantages of reducing the cost of the coil and of enabling an application to a printer of a high output per unit time, but also allows to supply a heat, generated in the excitation coil 1 itself by the high frequency current supplied thereto for electromagnetic induction heating, to the heating roller whereby the heat conventionally wasted by radiation or dissipated can be positively utilized for the fixation.

Therefore, as the energy conventionally wasted in elevating the temperature of the coil itself can be effectively utilized as an energy for fixation, it is possible to avoid a water in energy and to achieve an energy saving.

Second Embodiment

In the following a second embodiment will be explained with reference to FIGS. 6, 7 and 15.

The present embodiment utilizes a low-melting glass as the heat-resistant insulating material for covering the coil formed by the conductor without insulation covering. The concept of the embodiment 2 is an extension of the embodiment 1, which is more or less limited by the heat-resistant temperature of the resinous material. It is intended, by employing a low-melting glass as the heat-resistant insulating material, to provide an excitation coil usable up to 280 to 600° C. which is the heat-resistant temperature of the low-melting glass, and also to provide an inexpensive excitation coil unit by forming a more inexpensive coil by a pressing work from a plate material, though the conductor has a somewhat increased resistance corresponding to an increase in the heat-resistant temperature of the heat-resistant insulating material.

Figure 6:
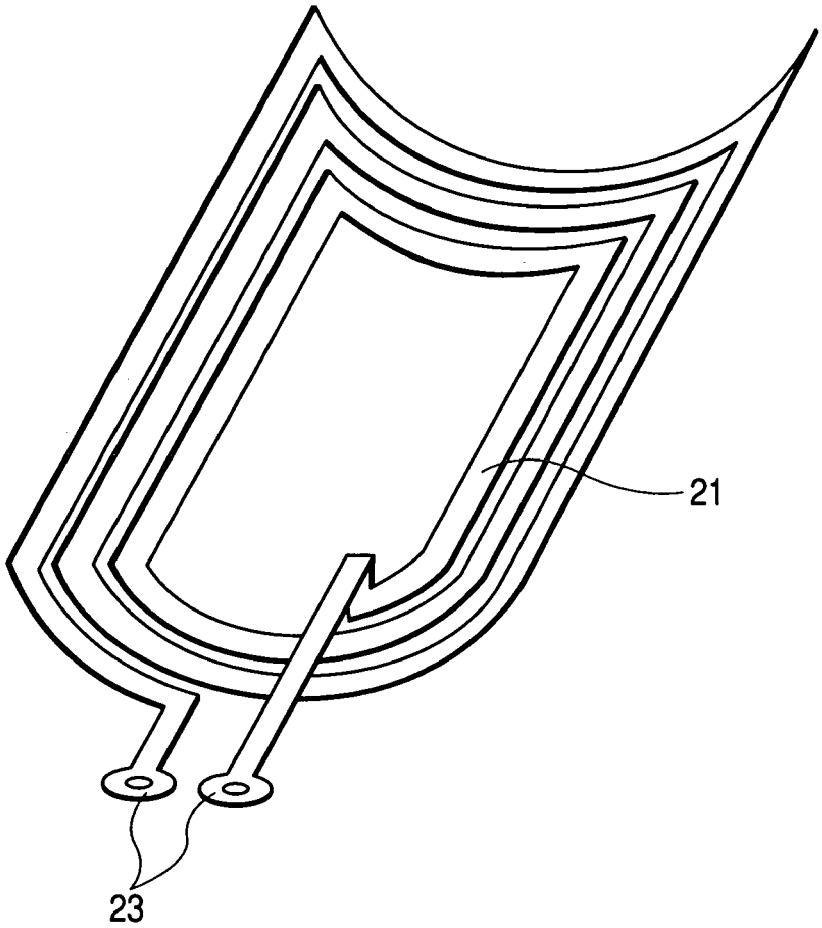
FIG. 6 shows a perspective view of an excitation coil in a second embodiment of the present invention.

FIG. 6 is a perspective view of an excitation coil in the second embodiment of the present invention.

Referring to FIG. 6, an excitation coil 21 has a substantially rectangular cross section, of which thickness is selected according to a drive frequency of a current flowing in the excitation coil.

By positively utilizing an area where an AC resistance becomes larger than a DC resistance because of the skin effect and selecting a thickness matching a penetration of the actual current, it is made possible, even for a conductor of a same cross section, to suppress the heat generation in the coil itself in case a DC current flows in the excitation coil in an abnormality, and to pass a current effectively in the entire cross section of the conductor in an normal operation, thereby suppressing the self heat generation and effectively utilizing the self-generated heat.

Also since such structure is associated with a less resistance increase by a proximity effect within a range of a same AC resistance, it is possible to reduce the cross section of the rectangular conductor to a minimum necessary value, thereby widening the freedom in designing and improving the space efficiency.

The excitation coil 21 is provided with power supply terminals 23 for supplying the excitation coil with a high frequency current.

The specifications of such excitation coil are shown in the table in FIG. 16, as already explained in the description of the embodiment 1.

It shows a loss of about 1.6 times in comparison with the embodiment 1, but is more inexpensive and can be sufficiently used as a fixing apparatus of a low-speed apparatus. This is because a fixing apparatus provided in a low-speed apparatus has a rated power of about 600 W, in contrast to that of a high-speed apparatus having a rated power of 800 to 900 W. Since the power loss is proportional to the resistance and proportional to a square of the current, a power loss calculated from the effective current flowing in the fixing apparatus remains same when the rated power is decreased from 800 W to 600 W, even if the resistance is increased to 1.77 times.

Figure 7:
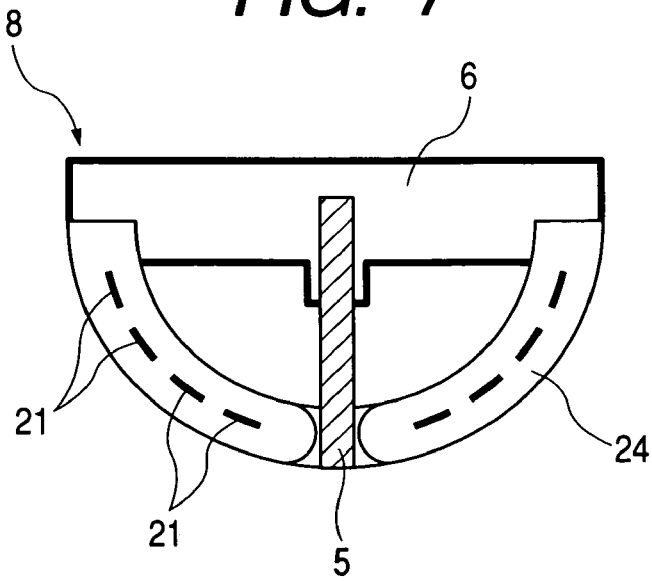
FIG. 7 shows a cross sectional view in a central portion of the excitation coil in the second embodiment of the present invention.
Figure 8:
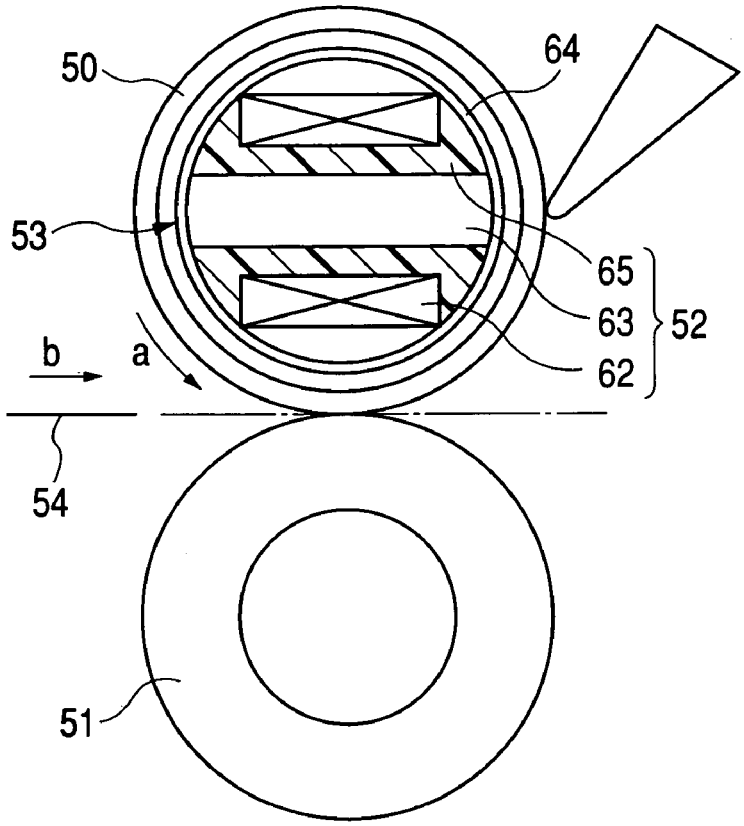
FIG. 8 shows a cross sectional view of a fixing apparatus of a prior example.
Figure 9:
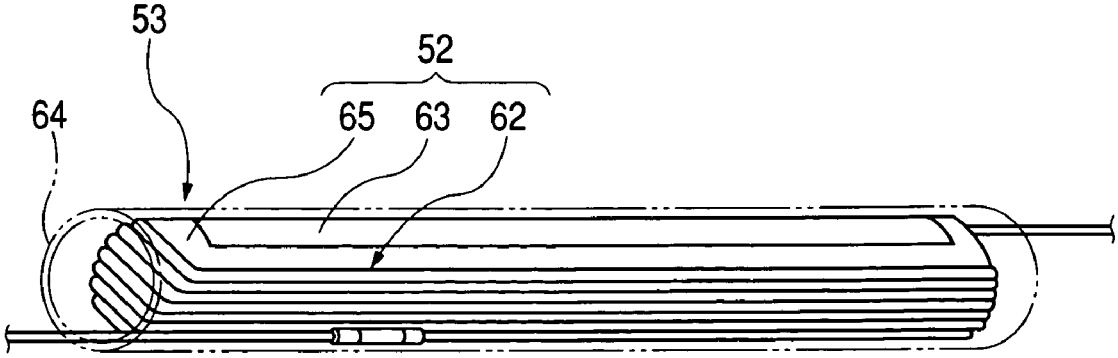
FIG. 9 shows a perspective see-through view of a holder unit provided in a heating roller of a prior fixing apparatus.

FIG. 7 is a cross sectional view of a central portion of the excitation unit 8 in the second embodiment of the present invention.

Referring to FIG. 7, an excitation coil 21 is formed by punching out a metal plate by a pressing operation, and then bent with such a curvature as to maintain a constant distance from the internal periphery of the fixing roller. Thereafter an excitation coil unit 24 is formed by integrally molding the excitation coil 21 with a glass of a linear expansion coefficient approximately equal to that of the excitation coil 21. Also the excitation coil unit 24 and a core 5 are fixed by holding with a holding member 6.

In such embodiment, based on the cross sectional shape of the conductor, there may be dispensed with the spacer 2 employed in the first embodiment for preventing the mutual shortcircuiting of the coil, but such spacer 2 may be provided in advance, in order to prevent a deformation of the coil in the direction of thickness thereof at the glass molding operation. In such case, the spacer 2 is preferably constituted of glass or an inorganic material.

In the following a detailed explanation will be given, with reference to FIG. 15, on the method for producing the excitation coil and the excitation coil unit 8 of the embodiment 2. FIG. 15 is a plan view of an induction heating coil 21 after punching by a pressing step.

At first, this coil is prepared by press punching a copper plate of a thickness (t) of 1.0 mm with a width (d) of 2.0 mm and a gap of 1.0 mm. In case the punching operation is difficult because of a narrow gap between the conductors, there may also be employed another working method such as etching.

After the coil removed from the press mold is deburred, it is coated with a barrier metal by a Ni plating. This step is important also for antioxidation of the coil surface, because the low-melting glass employed in the sealing step has a melting temperature as high as 280 to 400° C.

Then a bending mold (not shown) is used to bend a portion B in FIG. 15 thereby forming a lead portion.

Then the coil is set in a glass sealing mold (not shown) and a low-melting glass is poured and solidified by cooling, thereby obtaining an integrally molded article.

In order to prevent the oxidation of the coil conductor, the sealing operation with the low-melting glass is executed under a vacuum of $10^{-2}$ [Torr]. Under such reduced pressure, the oxidation scarcely takes place as the oxygen concentration is about 1 to 2 ppm. It is also possible to apply a nitrogen sealing. Also the poured glass is so selected as to have a linear expansion coefficient which is not much different from that of the copper material.

In case of preparing an excitation coil of 10 turns as shown in FIG. 15, it is difficult to obtain a conductor width of 2.0 mm or larger, in consideration of the line-and-space relationship. Therefore, the resistance becomes higher (about 1.27 times) than in the coil of the embodiment 1, thus increasing the heat generation in the coil 21 itself. Therefore, in case a resinous material is employed as the heat-resistant insulating material for sealing the coil, the coil temperature may exceed the heat-resistant temperature of such resin.

Consequently, the present embodiment executes a molding with a glass of a linear expansion coefficient approximately same as that of the excitation coil 21.

The use of the low-melting glass as the molding material substantially eliminates the limitation on the coil temperature to 220° C., and allows to employ a temperature higher than the fixing temperature selected in the embodiment 1.

Though a high-melting glass can further improve the heat resistance, there may be encountered problems of an oxidation or a heat resistance of the metal conductor of the induction heating coil, so that a low-melting glass is more preferable.

The present embodiment can effectively utilize the energy, conventionally wasted in the self heat generation in the coil, as the energy for fixation thereby avoiding a waste in energy and achieving an energy saving, in the same manner as in the first embodiment. In addition, the present embodiment, by forming the excitation coil 21 by press punching and bending of a metal plate, can easily and inexpensively produce an excitation coil with a conductor of a substantially rectangular cross section, without requiring an expensive wire obtained by twisting plural conductors, whereby a fixing apparatus of a high energy saving property can be realized inexpensively.

Also glass molding provides an advantage of improved reliability and durability to the temperature, since the heat resistance becomes higher than in the non-magnetic heat-resistant organic resinous material or the hybrid material.

Also since the glass material has a linear expansion coefficient approximately same as that of the excitation coil 21, there can be prevented generation of an internal stress in the excitation coil unit 24 by an expansion resulting from a temperature increase in the coil.

Third Embodiment

In the present embodiment, the excitation coil has a coil structure same as that in the second embodiment.

In place for the glass mold in the second embodiment, glasses preformed with a curvature are employed for sandwiching the excitation coil 21 and are then integrated by re-fusing. In this operation there is employed a glass material having a linear expansion coefficient approximately same as that of the excitation coil 21.

In the present embodiment, since there is no glass flow in the glass molding step as in the second embodiment, it is possible to dispense with the spacer more securely than in the second embodiment, thereby obtaining the excitation coil unit 24 more inexpensively.

Fourth Embodiment

Also in the present embodiment, the excitation coil has a coil structure same as that in the second embodiment. In place for the glass mold in the second embodiment, there is executed a sintering operation with an inorganic material such as a porcelain or ceramics. However, also in this case, it is necessary to execute the sintering in a nitrogen atmosphere in order to prevent oxidation of the coil.

It is possible to obtain a higher strength, a higher heat resistance and a higher insulating property than in the glass employed in the second embodiment.

(Function of Entire Image Forming Apparatus)

In the following there will be explained a function of an image forming apparatus, employing a fixing apparatus of the foregoing embodiments.

The image forming apparatus of this kind includes a copying apparatus, a printer, and a facsimile apparatus.

The copying apparatus generally has a function of reading an image for example of an original and forms an image on a sheet constituting a recording medium, based on the read image information, but there is also recently available a copying apparatus having a communicating function for entering image information transmitted from the exterior.

The printer forms an image on a sheet, constituting a recording medium, generally based on image information transmitted from an external apparatus such as a computer, and the facsimile apparatus generally has a function of reading an image for example of an original and a communicating function, and is capable of transmitting the read image information to the exterior and forming an image on a sheet, constituting a recording medium, based on information transmitted from the exterior.

As explained above, either apparatus serves to form an image on a sheet, constituting a recording medium, based on obtained image information.

In the following, an image forming apparatus, utilizing the fixing apparatus of the foregoing embodiments, will be explained briefly with reference to FIG. 10.

As shown in FIG. 10, in an image forming apparatus 100, a laser scanner 101 emits a laser light L based on the obtained image information, thereby irradiating a photosensitive drum 103 incorporated in a process cartridge 102.

Thus a latent image is formed on the photosensitive drum 103, and is rendered visible by a development with a toner in the process cartridge 102.

On the other hand, a sheet S stacked on a sheet stacking plate 104 is separated one by one and fed by a feed roller 105 and a separating pad 106, and further conveyed in a downstream direction by conveying rollers 107, and the visible toner image formed on the photosensitive drum 103 is transferred by transfer means 108 onto thus conveyed sheet.

The sheet bearing the unfixed toner image is further conveyed in the downstream direction, and, after a fixation of the toner image by an aforementioned fixing apparatus 109, discharged from the apparatus by discharge rollers 110.

Thus, in an image forming apparatus such as a copying apparatus or a printer, it is rendered possible, by at least employing the aforementioned fixing apparatus for the toner fixation of an electrophotographic process, to effectively utilize the electric power charged into the fixing apparatus thereby realizing inexpensively an image forming apparatus such as a copying apparatus or a printer capable of avoiding a waste in energy and achieving an energy saving in the entire apparatus.

The present invention is not limited to the foregoing embodiments but includes any and all modifications belonging to a same technical concept.

What is claimed is:

1. An image heating apparatus comprising:

a cylindrical-shaped rotatable conductive member; and an excitation coil unit for generating a magnetic field to induce an eddy cuffent in said rotatable conductive member, wherein said excitation coil unit includes:

a coil formed with a conductor that has a rectangular cross section, for generating the magnetic field, said coil has a linear portion parallel to a rotation axis of said cylindrical-shaped rotatable conductive member and a curl portion corresponding to a curvature of said cylindrical- shaped rotatable conductive member; and a heat-resistant insulating material which is injected into a space between any of the conductive portions and around the entire coil, and cured, to prevent from causing a short circuit between adjacent conductive portions, and wherein said heat-resistant insulating material is a part of a holder to hold said coil.

2. An image heating apparatus according to claim 1, wherein said heat-resistant insulating material is made by being poured between conductive portions of said conductor and around said coil and then hardened.

3. An image heating apparatus according to claim 2, wherein said heat-resistant insulating material is a resinous material.

4. An image heating apparatus according to claim 2, wherein said heat-resistant insulating material is a glass.

* * * * *